US009754715B2

(12) United States Patent
Zhou et al.

(10) Patent No.: US 9,754,715 B2
(45) Date of Patent: Sep. 5, 2017

(54) MAGNETIC ASSEMBLY

(71) Applicant: DELTA ELECTRONICS (SHANGHAI) CO., LTD., Shanghai (CN)

(72) Inventors: Jinping Zhou, Shanghai (CN); Xiuli Mei, Sahnghai (CN); Min Zhou, Sahnghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 15/265,646

(22) Filed: Sep. 14, 2016

(65) Prior Publication Data

US 2017/0084382 A1 Mar. 23, 2017

(30) Foreign Application Priority Data

Sep. 23, 2015 (CN) ..... 2015 1 0612418

(51) Int. Cl.

| | |
|---|---|
| ***H01F 27/08*** | (2006.01) |
| ***H01F 27/28*** | (2006.01) |
| ***H01F 27/34*** | (2006.01) |
| *H01F 3/10* | (2006.01) |

(52) U.S. Cl.

CPC ..... *H01F 27/2847* (2013.01); *H01F 27/08* (2013.01); *H01F 27/28* (2013.01); *H01F 27/346* (2013.01); *H01F 2003/106* (2013.01); *H01F 2027/2857* (2013.01)

(58) Field of Classification Search

CPC ..... H01F 27/00–27/30

USPC ..... 336/65, 83, 178, 200, 232, 220–223

See application file for complete search history.

(56) References Cited

U.S. PATENT DOCUMENTS

| | | | | |
|---|---|---|---|---|
| 7,176,775 | B2 * | 2/2007 | Ohta | H01F 27/2847 336/200 |
| 7,321,283 | B2 * | 1/2008 | Mehrotra | H01F 27/2804 336/200 |
| 8,183,966 | B2 * | 5/2012 | Xu | H01F 27/2847 336/170 |
| 9,412,510 | B2 * | 8/2016 | Chu | H01F 27/346 |
| 2006/0038650 | A1 * | 2/2006 | Mehrotra | H01F 27/2804 336/83 |

* cited by examiner

*Primary Examiner* — Tuyen Nguyen

(74) *Attorney, Agent, or Firm* — Kirton McConkie; Evan R. Witt

(57) ABSTRACT

A magnetic assembly includes a magnetic core and at least one foil winding assembly. The magnetic core includes plural magnetic legs. At least one magnetic path is defined by the plural magnetic legs collaboratively. Moreover, at least one low-permeability structure is formed in at least one specified magnetic leg of the plural magnetic legs. The at least one foil winding assembly is wound around the specified magnetic leg. Consequently, plural winding parts in a multi-layered arrangement are sequentially stacked on the specified magnetic leg. A direction of a conductor thickness of each winding part is perpendicular to a direction of a magnetic flux through the specified magnetic leg. The plural winding parts are gradually close to the low-permeability structure along an arranging direction, and the conductor thicknesses of at least two of the plural winding parts are gradually decreased along the arranging direction.

15 Claims, 9 Drawing Sheets

5G

MAGNETIC ASSEMBLY

FIELD OF THE INVENTION

The present invention relates to a magnetic assembly, and more particularly to a magnetic assembly with an optimized foil winding assembly in order to reduce the winding loss.

BACKGROUND OF THE INVENTION

Recently, switching power supply apparatuses are developed toward miniaturization or high power density. Generally, the switching power supply apparatus comprises a magnetic assembly (e.g., an inductor or a transformer). The volume, weight, loss and cost of the magnetic assembly are very critical to the switching power supply apparatus. As known, the increase of switching frequency of the switching power supply apparatus can reduce the volume of the magnetic assembly and increase the power density of the switching power supply apparatus. As the frequency of the switching power supply apparatus is increased, the requirement of designing the magnetic assembly becomes more stringent. In the high-frequency application, it is important to reduce the loss of the magnetic assembly without increasing the overall volume.

Generally, the loss of the magnetic assembly contains core loss and winding loss. In the high-frequency application, the reduction of the eddy-current loss is effective to reduce the winding loss of the magnetic assembly. In the high-frequency application of the magnetic assembly, a Litz wire or a foil conductor is used in the winding assembly of the magnetic assembly. As known, the winding assembly with the Litz wire has reduced eddy-current loss. However, since each strand of the Litz winding is covered with an insulation layer and the Litz wire comprises many strands, the Litz winding has a small filling factor and the heat generated by the Litz wire is difficultly dissipated. Moreover, in comparison with the foil winding assembly, the Litz winding assembly is detrimental to the flat design and mass production. Consequently, the Litz winding assembly is gradually replaced by the foil winding assembly. In other words, while designing the magnetic assembly, it is important to reduce the winding loss of the foil winding assembly.

Conventionally, a magnetic assembly (e.g., a planar inductor) comprises a magnetic core, a foil winding assembly and a low-permeability structure. The magnetic core is constituted by plural magnetic legs. The low-permeability structure is formed in one of the plural magnetic legs in order to prevent the occurrence of magnetic saturation. The foil winding assembly comprises plural layers of winding parts.

The parameters influencing the winding loss of the magnetic assembly include the conductor thicknesses of the winding parts. Conventionally, for easily designing and producing the winding assembly, all conductor layers of the winding parts of the winding assembly have equal thickness. However, it is not an optimized option for the magnetic assembly, and the total winding loss of the magnetic assembly with this foil winding assembly is still very high.

Therefore, there is a need of provides a magnetic assembly with an optimized foil winding assembly in order to reduce the winding loss.

SUMMARY OF THE INVENTION

An object of the present invention provides a magnetic assembly. Since the conductor thicknesses of the winding parts of the foil winding assembly are optimized, the winding loss of the magnetic assembly is reduced. When the magnetic assembly is used in the high-frequency application, the magnetic assembly has reduced winding loss without the need of increasing the volume of the magnetic assembly. Consequently, the miniaturization of the switching power supply apparatus is achievable.

In accordance with an aspect of the present invention, there is provided a magnetic assembly. The magnetic assembly includes a magnetic core and at least one foil winding assembly. The magnetic core includes plural magnetic legs. At least one magnetic path is defined by the plural magnetic legs collaboratively. Moreover, at least one low-permeability structure is formed in at least one specified magnetic leg of the plural magnetic legs. The at least one foil winding assembly is wound around the specified magnetic leg. Consequently, plural winding parts in a multi-layered arrangement are sequentially stacked on the specified magnetic leg. A direction of a conductor thickness of each winding part is perpendicular to a direction of a magnetic flux through the specified magnetic leg. The plural winding parts are gradually close to the low-permeability structure along an arranging direction, and the conductor thicknesses of at least two of the plural winding parts are gradually decreased along the arranging direction.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
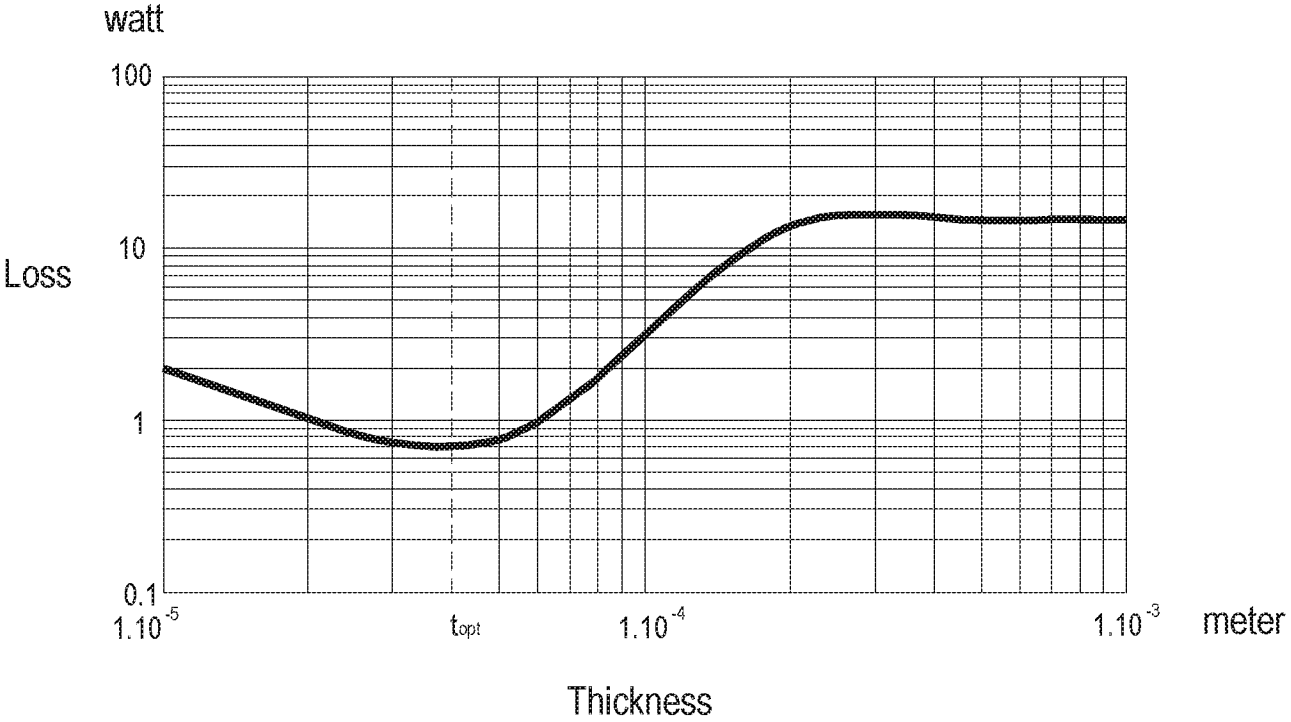
FIG. 1 is a plot illustrating the relationship between the conductor thickness and the loss of a general magnetic assembly.

The present invention provides a magnetic assembly. The magnetic assembly uses an optimized foil winding assembly to reduce the winding loss. In the high-frequency application, the winding loss varies with the conductor thickness of the winding part because of the skin effect and the proximity effect. For reducing the winding loss, it is necessary to acquire the optimized thickness of each winding part when the skin effect and the proximity effect are taken into consideration. FIG. 1 is a plot illustrating the relationship between the conductor thickness and the loss of a general magnetic assembly. As shown in FIG. 1, the total winding loss P varies with the conductor thickness t of a winding part of a winding assembly. Generally, in case that the conductor thickness of the winding part is in the range between $1\times10^{-5}$ meter and $1\times10^{-4}$ meter, the winding loss is the minimum. Under this circumstance, the winding part has an optimized thickness $t_{opt}$. That is, the winding loss varies with the conductor thickness. If the conductor thickness exceeds the optimized thickness, the eddy-current loss in the high-frequency application gradually increases. In case that the winding parts of the foil winding assembly have the equal thickness, additional winding loss is possibly generated.

Generally, the winding loss of the n-th layer of the winding part is related to the magnetic-field intensity H at the bilateral sides of the n-th layer. Moreover, a closed loop is defined by plural magnetic legs of the magnetic core. Since the magnetic leg without the low-permeable material has higher magnetic permeability, the magnetic-field intensity in the magnetic core is negligible. According to Ampere circuital theorem, the magnetic-field intensity at the top surface of the n-th layer of the winding part may be estimated and expressed by the mathematic formula (1):

$$H_n = \frac{n \cdot I_0}{W} \tag{1}$$

In the above mathematic formula (1), W is the conductor width, and $I_0$ is the current flowing through each layer of conductor of the winding part. Similarly, the magnetic-field intensity at the bottom surface of the n-th layer of the winding part may be expressed by the following mathematic formula:

$$H_{n-1} = \frac{(n-1) \cdot I_0}{W} \tag{2}$$

From the mathematic formulae (1) and (2), it is found that the magnetic-field intensity closer to the bilateral sides of the winding part around the magnetic leg with the low-permeable material is relatively larger. According to a one-dimensional Dowell model, the loss $P_{Sn}$ caused by the skin effect of the n-th layer of the winding part and the loss $P_{Pn}$ caused by the proximity effect of the n-th layer of the winding part can be expressed by the following mathematic formulae:

$$Ps_n = \frac{W}{4\sigma\delta}|H_n - H_{n-1}|^2 \frac{\sin v + \sin v}{\cosh v - \cos v} \tag{3}$$

$$Pp_n = \frac{W}{4\sigma\delta}|H_n - H_{n-1}|^2 \frac{\sin v - \sin v}{\cosh v + \cos v} \tag{4}$$

In the above formulae (3) and (4), σ is the electric conductivity of the conductor, δ is the skin depth of the conductor, and v is equal to $t_n/\delta$, wherein $t_n$ is the thickness of the n-th layer of the winding part. Consequently, the total loss of the n-th layer of the winding part can be expressed by the following mathematic formula:

$$P_n = Ps_n + Pp_n \tag{5}$$

The total winding loss of the winding assembly is calculated according to the summation of the loss of all layers of the conductor. That is, the total winding loss is expressed by the following mathematic formula:

$$P = \Sigma_1^N P_n \tag{6}$$

In case that all conductor layers of the winding part of the winding assembly have the identical thickness t, the relationship between the total winding loss P and the thickness t is shown in FIG. 1. Moreover, in case that the conductor thickness of the winding part is equal to the optimized thickness $t_{opt}$, (for example, in the range between $1\times10^{-5}$ meter and $1\times10^{-4}$ meter), the winding loss is the minimum. Since all conductor layers of the winding part of the winding assembly have the equal thickness, the winding assembly can be designed and produced easily. However, the winding assembly of this design may result additional winding loss. According to the analysis with the mathematic formulae (3) and (4), different conductor layers of the winding part have different optimized thicknesses $t_{opt}$. Consequently, if different conductor layers of the winding part have their optimized thicknesses, the overall winding loss is the lowest. For clearly understanding the technology of the present invention, two function $A_1(v)$ and $A_2(v)$ are defined and expressed by the following mathematic formulae:

$$A_1(v) = \frac{\sin v + \sin v}{\cosh v - \cos v} \tag{7}$$

$$A_2(v) = \frac{\sin v - \sin v}{\cosh v + \cos v} \tag{8}$$

Figure 2:
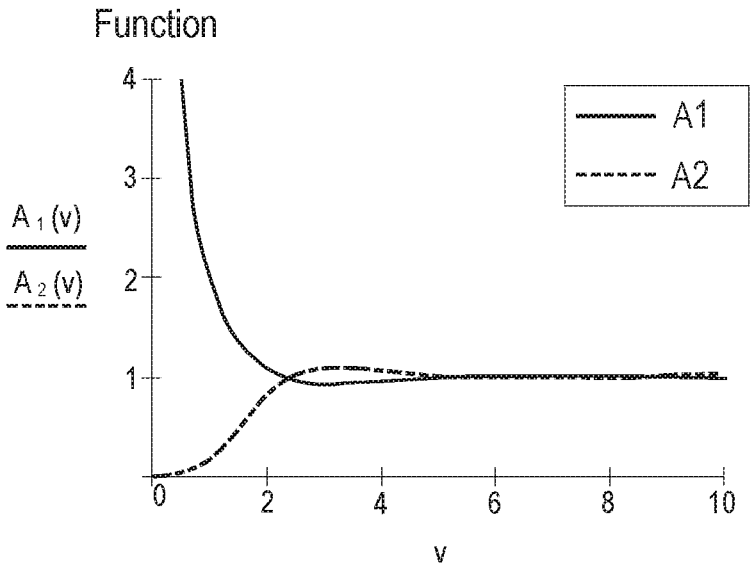
FIG. 2 is a plot illustrating the relationships between the skin effect loss, the proximity effect loss and the conductor thickness of the winding part.

The relationships between the above two functions and the change of the conductor thickness of the winding part are depicted in FIG. 2. FIG. 2 is a plot illustrating the relationships among the skin effect loss, the proximity effect loss and the conductor thickness of the winding part. Then, please refer the mathematic formulae (3), (4), (7), (8) and FIG. 2. After the magnetic-field intensities $H_n$ and $H_{n-1}$ at the bilateral sides of the winding part are obtained, the skin effect loss $Ps_n$ decreases with the increasing of the conductor thickness, and the proximity effect loss $Pp_n$ increases with the increasing of the conductor thickness. When the total winding loss of the magnetic assembly is taken into consideration, the conductor thickness of the winding part is determined according to the fractions of the skin effect loss and the proximity effect loss. If the skin effect loss has the greater fraction, a larger conductor thickness of the winding part can be selected. Whereas, if the proximity effect loss has the greater fraction, a smaller conductor thickness of the winding part can be selected. After the formulae (1) and (2) are substituted into the formulae (3) and (4), it is found that the skin effect loss values of all conductor layers are equal but the proximity effect loss values of all conductor layers are different. Moreover, the magnetic-field intensity becomes larger, and the proximity effect loss becomes larger when closer to the magnetic leg with the low-permeable structure. That is, the closer to the magnetic leg with the low-permeable structure, the smaller the conductor thickness of the winding part should be selected to reduce the loss.

Figure 3:
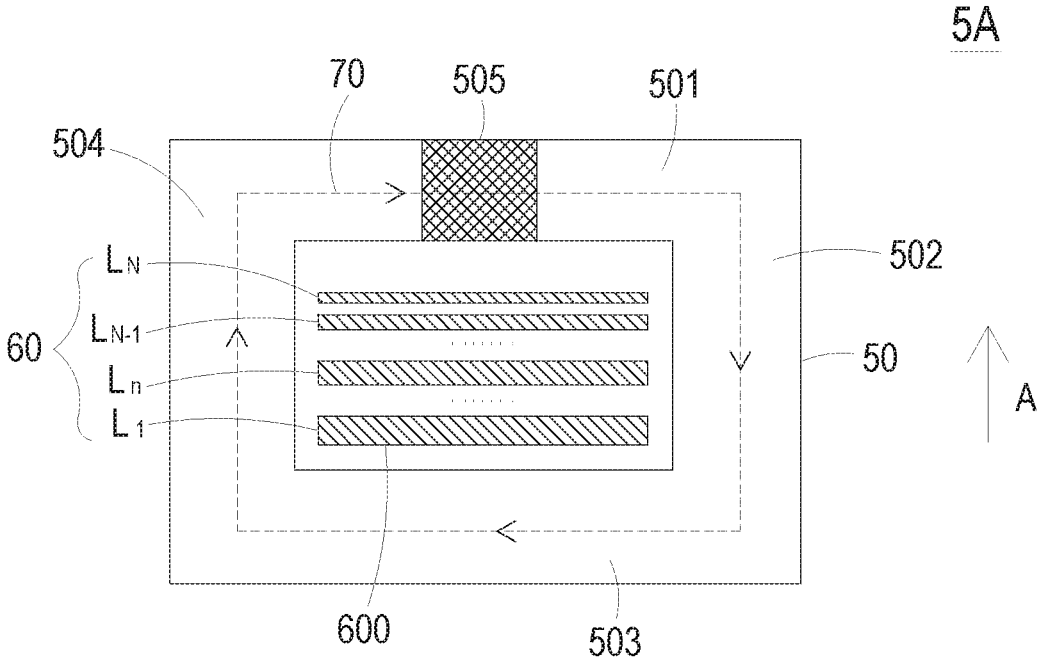
FIG. 3 schematically illustrates a magnetic assembly according to a first embodiment of the present invention.

FIG. 3 schematically illustrates a magnetic assembly according to a first embodiment of the present invention. As shown in FIG. 3, the magnetic assembly 5A comprises a magnetic core 50, at least one foil winding assembly 60 and a low-permeability structure 505. In this embodiment, the magnetic core 50 comprises a first magnetic leg 501, a second magnetic leg 502, a third magnetic leg 503 and a fourth magnetic leg 504. Moreover, a magnetic path 70 is defined by the four magnetic legs of the magnetic core 50. Especially, the low-permeability structure 505 is formed in one of the four magnetic legs. In this embodiment, the low-permeability structure 505 is formed in the first magnetic leg 501. The foil winding assembly 60 is wound around the first magnetic leg 501 in a multi-layered winding manner. That is, plural winding parts 600 in a multi-layered arrangement are sequentially stacked on the first magnetic leg 501. For succinctness, only some winding parts are shown in the drawings. In this embodiment, the foil winding assembly 60 is partially accommodated within a receiving space that is defined by the first magnetic leg 501, the second magnetic leg 502, the third magnetic leg 503 and the fourth magnetic leg 504 of the magnetic core 50. Moreover, in the foil winding assembly 60, the direction of the conductor thickness $t_n$ of each winding part 600 is perpendicular to the direction of the magnetic flux through the magnetic leg with the low-permeability structure (i.e. the first magnetic leg 501 in the embodiment). Among the plural winding parts 600 in the multi-layered arrangement, the $L_n$ layer is the closest to the low-permeability structure 505, and the $L_1$ layer is the farthest from the low-permeability structure 505. In this embodiment, the conductor thickness $t_N$ of the $L_n$ layer is smaller than the conductor thickness $t_1$ of the $L_1$ layer 600 (i.e., $t_1>t_N$).

The plural winding parts 600 of the foil winding assembly 60 are gradually close to the low-permeability structure 505 along an arranging direction A. In addition, the conductor thicknesses of the plural winding parts 600 are gradually decreased along the arranging direction A. In this embodiment, the conductor of the foil winding assembly 60 has a rectangular cross section, and the width-to-thickness ratio of the conductor is larger than 5.

In the magnetic core 50, the first magnetic leg 501 and the third magnetic leg 503 are in parallel with each other, the second magnetic leg 502 and the fourth magnetic leg 504 are in parallel with each other, and the first magnetic leg 501 and the third magnetic leg 503 are perpendicular to the second magnetic leg 502 and the fourth magnetic leg 504.

In an embodiment, compared to other magnetic leg, the magnetic leg with the low-permeability structure 505 (e.g., the first magnetic leg 501) has a lower permeability. The low-permeability structure 505 is made of a low permeability material with permeability in the range between 1 and 50. An example of the low permeability material includes but is not limited to air or powder cores. The other magnetic legs (e.g., the second magnetic leg 502, the third magnetic leg 503 and the fourth magnetic leg 504) are made of a high permeability material with permeability higher than 50. An example of the high permeability material includes but is not limited to ferrite or an amorphous material.

In an embodiment, the foil winding assembly 60 is implemented with a multi-layered printed circuit board, and the plural winding parts 600 of the foil winding assembly 60 correspond to different layers of the multi-layered printed circuit board. In some other embodiments, the foil winding assembly 60 is implemented with a copper foil winding assembly or an aluminum foil winding assembly.

Please refer to FIG. 3 again. In this embodiment, the conductor thicknesses of the plural winding parts 600 of the foil winding assembly 60 are different. In any two adjacent winding parts, the conductor thickness of the winding part 600 closer to the low-permeability structure 505 is smaller than the conductor thickness of the winding part 600 farther away the low-permeability structure 505. As shown in FIG. 3, the plural winding parts 600 of the foil winding assembly 60 from the $L_1$ layer to the $L_N$ layer have conductor thicknesses t1, t2, . . . , $t_{N-1}$ and $t_N$, wherein $t_1>t_2>\ldots t_n\ldots>t_{N-1}>t_N$. The relationships between the conductor thicknesses of the winding parts 600 and the loss will be described as follows. For example, the plural winding parts 600 comprise ten layers (i.e., N=10). It is noted that the number of layers is not restricted.

Figure 4:
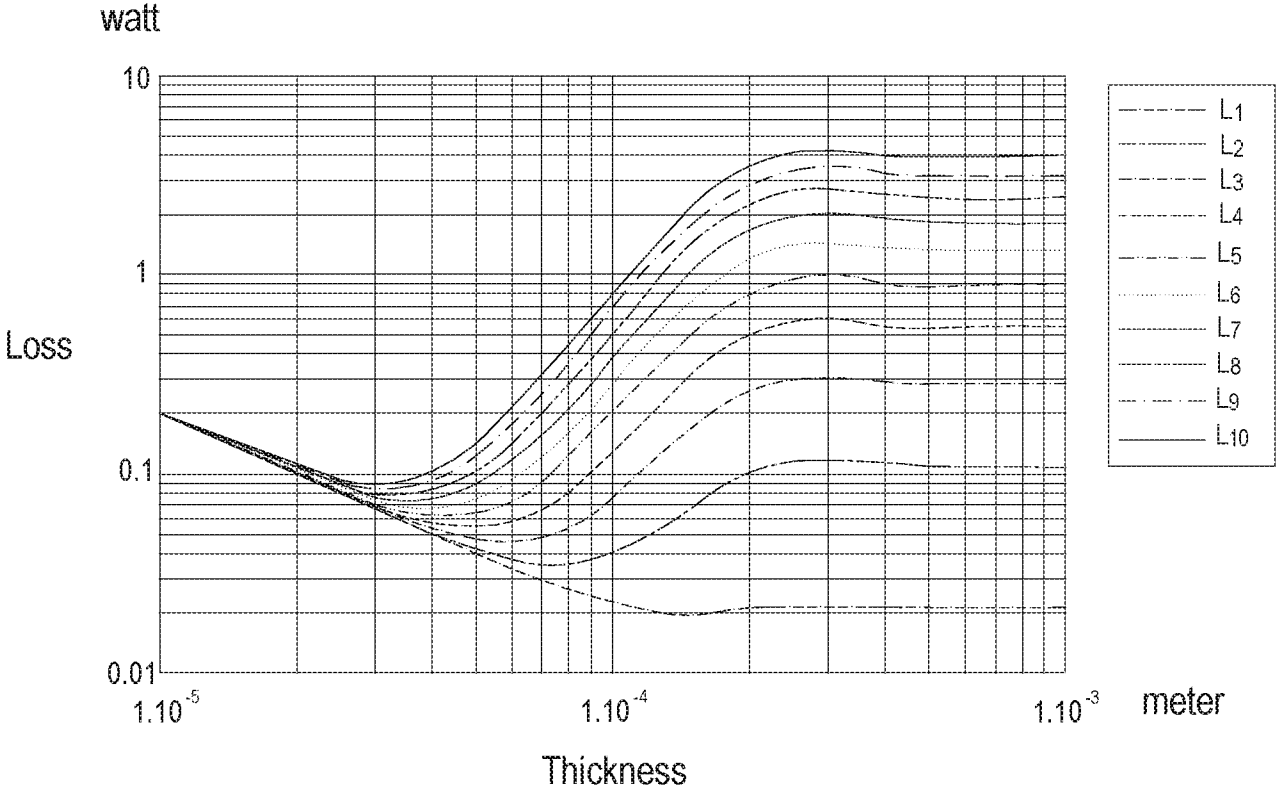
FIG. 4 is a plot illustrating the relationship between the conductor thickness of each winding part and the loss of the magnetic assembly of FIG. 3.

FIG. 4 is a plot illustrating the relationship between the conductor thickness of each winding part and the loss of the magnetic assembly of FIG. 3. In FIG. 4, the horizontal axis indicates the conductor thickness t (meter) of each winding part, and the vertical axis indicates winding loss P (Watt). The curves $L_1$~$L_{10}$ indicate the relationships between the conductor thicknesses of each winding part and the corresponding loss. For example, the curve Ln indicates the relationship between the conductor thickness $t_n$ of the n-th layer of winding part and the winding loss. In each of these curves $L_1$~$L_{10}$, the conductor thickness corresponding to the minimum loss is the optimized thickness of the corresponding winding part 600. After the optimized thicknesses of all winding parts 600 are acquired, the winding assembly with the lowest loss can be designed.

The design parameters and total loss of the magnetic assembly of the present invention (e.g., FIG. 3) and two conventional magnetic assemblies are listed in the comparison table 1. The conditions of evaluating the total loss include: (1) the effective value of the electric current flowing through each layer of winding part is 1 ampere, (2) the frequency is 500 kHz, (3) the conductor width of the winding part 600 is 8.5 mm, (4) the conductor length of the winding part is 1 m, (5) the temperature is the normal room temperature, and (6) the skin depth of the copper conductor at 500 kHz is 0.093 mm.

TABLE 1

| | Conventional scheme 1 (equal thickness) | | Conventional scheme 2 (equal thickness) | | Present scheme (unequal thickness) | |
|---|---|---|---|---|---|---|
| N (1 ≤ n ≤ 10) | thickness (mm) | thickness/skin depth | thickness (mm) | thickness/skin depth | thickness (mm) | thickness/skin depth |
| 1 | 0.04 | 0.43 | 0.054 | 0.58 | 0.140 | 1.51 |
| 2 | | | | | 0.075 | 0.81 |
| 3 | | | | | 0.060 | 0.65 |
| 4 | | | | | 0.050 | 0.54 |

TABLE 1-continued

| N (1 ≤ n ≤ 10) | Conventional scheme 1 (equal thickness) thickness (mm) | Conventional scheme 1 (equal thickness) thickness/skin depth | Conventional scheme 2 (equal thickness) thickness (mm) | Conventional scheme 2 (equal thickness) thickness/skin depth | Present scheme (unequal thickness) thickness (mm) | Present scheme (unequal thickness) thickness/skin depth |
|---|---|---|---|---|---|---|
| 5 | | | | | 0.045 | 0.49 |
| 6 | | | | | 0.040 | 0.43 |
| 7 | | | | | 0.037 | 0.40 |
| 8 | | | | | 0.034 | 0.37 |
| 9 | | | | | 0.032 | 0.35 |
| 10 | | | | | 0.030 | 0.32 |
| Total thickness (mm) | 0.4 | | 0.54 | | 0.54 | |
| Total loss (mW) | 689 | | 840 | | 605 | |

Please refer to Table 1. In the conventional scheme 1, the winding parts of the magnetic assembly have the equal thickness (e.g., 0.04 mm). The optimized thickness corresponding to the minimum loss is selected as the conductor thickness of each winding part according to the plot of FIG. 1, and the thickness/skin depth corresponding to the conductor thickness is 0.43. Under this circumstance, the total thickness of the winding parts is 0.4 mm, and the total loss of the winding parts is 689 mW. In the conventional scheme 2, the winding parts of the magnetic assembly have the equal thickness (e.g., 0.054 mm), and the thickness/skin depth corresponding to the conductor thickness is 0.58. Under this circumstance, the total thickness of the winding parts is 0.54 mm, and the total loss of the winding parts is 840 mW. The magnetic assembly of the present scheme is designed according to the concept of FIG. 3. Moreover, the conductor thickness corresponding to the minimum loss is the optimized thickness of the corresponding winding part. For example, the conductor thickness of the first layer of the winding part ($L_1$) is 0.140 mm, and the thickness/skin depth corresponding to the conductor thickness is 1.51. The rest may be deduced by analogy. Under this circumstance, the total thickness of the winding parts is 0.54 mm, and the total loss of the winding parts is 605 mW. The total thickness of the magnetic assembly in the present scheme is identical to the total thickness of the magnetic assembly in the conventional scheme 2. According to the data shown in Table 1, the total loss of the present scheme is 12.2% lower than the conventional scheme 1, and the total loss of the present scheme is 27.9% lower than the conventional scheme 2. When compared with the conventional magnetic assembly, the winding loss of the magnetic assembly of the present invention is reduced. Consequently, the operating performance of the magnetic assembly of the present invention is enhanced.

Figure 5:
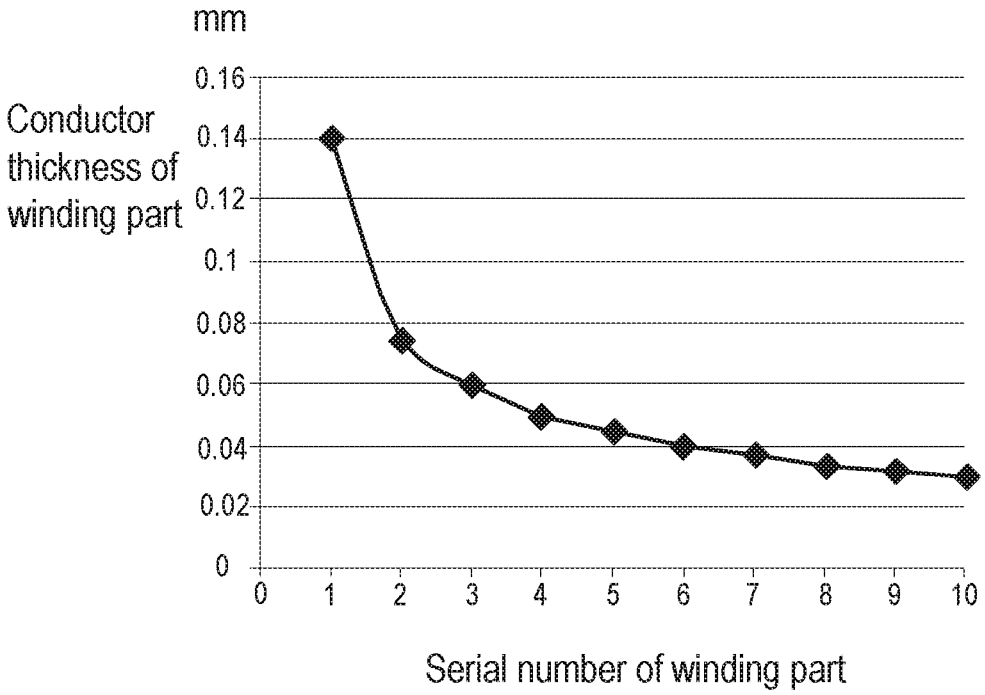
FIG. 5 is a plot illustrating the relationships between the conductor thickness and each layer of winding part according to the data listed in Table 1.

FIG. 5 is a plot illustrating the relationships between the conductor thickness and each layer of winding part according to the data listed in Table 1. In FIG. 5, the horizontal axis indicates the serial numbers of the winding parts (i.e., from the $L_1$ layer to the $L_{10}$ layer), and the vertical axis indicates the conductor thicknesses of the winding parts. As shown in FIG. 5, the winding part 600 closer to the low-permeability structure 505 has the smaller optimized thickness. Another derivate conclusion is, the more the layers of the winding parts are, the smaller the conductor thicknesses close to the low-permeability structure are. In practical applications, the conductor thickness of each winding part 600 has an allowable tolerance. For example, when the foil winding assembly 60 is implemented with a multi-layered circuit board, the allowable tolerance for each winding part of the foil winding assembly is usually in the range between 10 μm and 20 μm. Consequently, if the optimized thickness difference between adjacent winding parts 600 is smaller than the allowable tolerance, the above concept is still feasible in statistics that the winding part 600 closer to the low-permeability structure 505 has the smaller optimized thickness. That is, even if only some winding parts comply with the above requirement, the total winding loss of the magnetic assembly is reduced.

Figure 6:
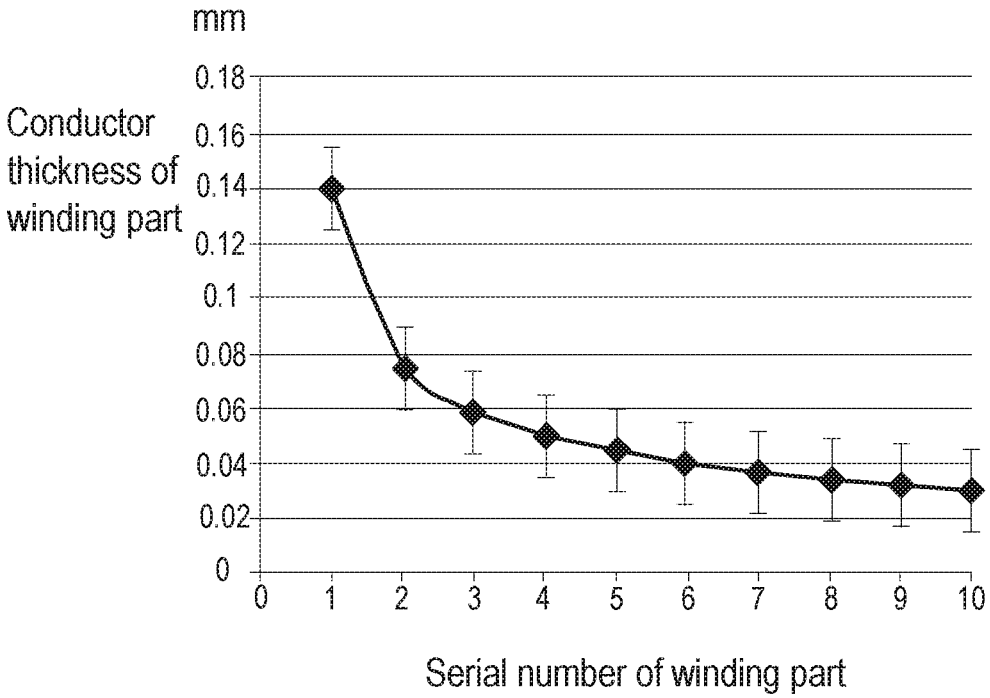
FIG. 6 is a plot illustrating the relationships between the conductor thickness and each layer of winding part according to the data listed in Table 1, in which the allowable tolerance is included.

FIG. 6 is a plot illustrating the relationships between the conductor thickness and each layer of winding part according to the data listed in Table 1, in which the allowable tolerance is included. As shown in FIG. 6, if the conductor thicknesses of the winding parts 600 ($L_1$~$L_{10}$) are gradually decreased (i.e. $t_1>t_2> \ldots t_n \ldots >t_{N-1}>t_N$) and even if the optimized thickness difference between adjacent winding parts 600 is smaller than the allowable tolerance, the above concept is still feasible in statistics that the winding part 600 closer to the low-permeability structure 505 has the smaller optimized thickness.

In the above embodiment, the winding parts 600 of the foil winding assembly 60 have different conductor thicknesses. It is noted that numerous modifications and alterations may be made while retaining the teachings of the invention. For example, in some other embodiments, some adjacent winding parts 600 may have the equal thickness. Under this circumstance, the winding assembly can be produced more easily.

The design parameters and total loss of another exemplary magnetic assembly of the present invention and a conventional magnetic assembly are listed in the comparison table 2. The data of the magnetic assembly of the conventional scheme 1 are identical to those listed in Table 1.

TABLE 2

| N(1 ≤ n ≤ 10) | Conventional scheme 1 (equal thickness) thickness (mm) | Conventional scheme 1 (equal thickness) thickness/skin depth | Present scheme (unequal thickness) thickness (mm) | Present scheme (unequal thickness) thickness/skin depth |
|---|---|---|---|---|
| 1 | 0.04 | 0.43 | 0.05 | 0.54 |
| 2 | | | 0.05 | 0.54 |
| 3 | | | 0.05 | 0.54 |
| 4 | | | 0.04 | 0.43 |
| 5 | | | 0.04 | 0.43 |
| 6 | | | 0.04 | 0.43 |
| 7 | | | 0.04 | 0.43 |
| 8 | | | 0.03 | 0.32 |
| 9 | | | 0.03 | 0.32 |
| 10 | | | 0.03 | 0.32 |
| Total thickness (mm) | 0.4 | | 0.4 | |
| Total loss (mW) | 689 | | 641 | |

The conditions of evaluating the total loss are similar to those of evaluating the total loss that is listed in Table 1, and the magnetic assembly of the conventional scheme 1 has the same configuration as that listed in Table 1. However, the winding parts 600 of the foil winding assembly 60 of this embodiment are classified into several groups according to the conductor thicknesses. That is, the adjacent winding parts 600 belonging to the same group have the equal thickness. The group closer to the low-permeability structure 505 has the smaller optimized thickness. In other words, the conductor thicknesses of the plural winding parts are gradually decreased along the arranging direction in steps. The number of the steps is arbitrary. Moreover, each step corresponds to one winding part or a specified number of adjacent winding parts.

Figure 7:
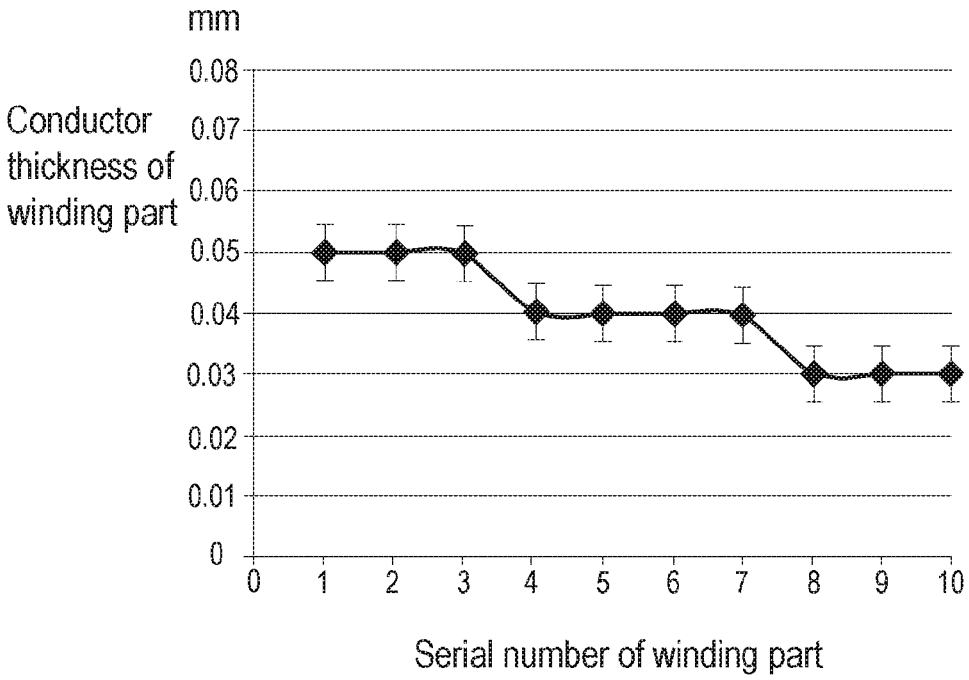
FIG. 7 is a plot illustrating the relationships between the conductor thickness and each layer of winding part according to the data listed in Table 2, in which the allowable tolerance is included.

FIG. 7 is a plot illustrating the relationships between the conductor thickness and each layer of winding part according to the data listed in Table 2, in which the allowable tolerance is included. In this embodiment, the winding parts 600 of the foil winding assembly 60 are classified into three groups according to the conductor thicknesses. Three adjacent winding parts 600 belonging to the first group (i.e., the first, second and third layers) have the equal thickness (e.g., 0.05 mm). Four adjacent winding parts 600 belonging to the second group (i.e., the fourth, fifth, sixth and seventh layers) have the equal thickness (e.g., 0.04 mm). Three adjacent winding parts 600 belonging to the third group (i.e., the eighth, ninth and tenth layers) have the equal thickness (e.g., 0.03 mm). In this embodiment, the conductor thicknesses of the plural winding parts are gradually decreased along the arranging direction in steps. In addition, the total loss of the winding parts is 641 mW. According to the data shown in Table 2, the total loss of the present scheme is 7% lower than the conventional scheme 1. It is noted that the number of groups and the number of winding parts in each group may be varied according to the practical requirements.

Figure 8:
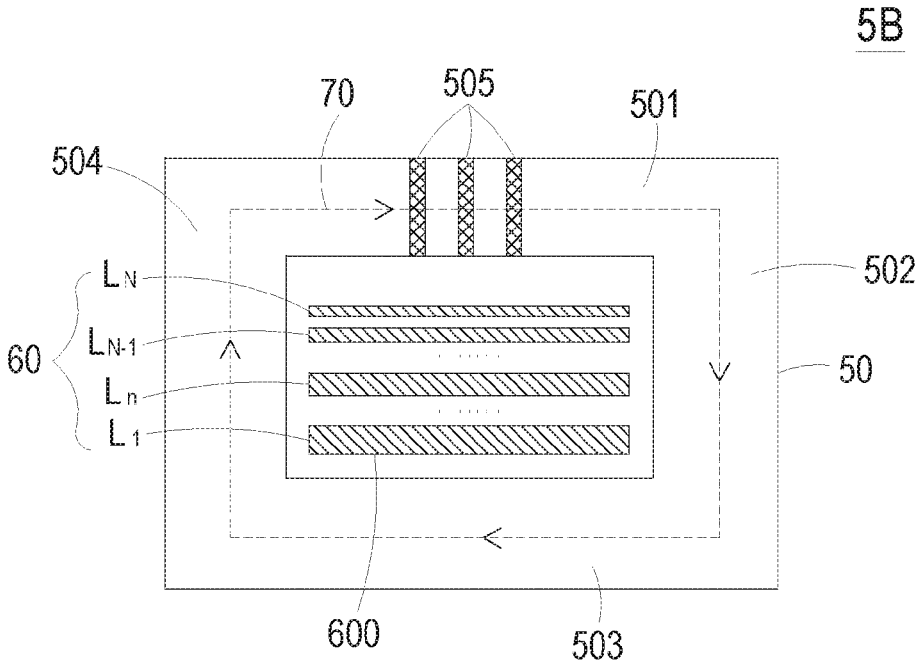
FIG. 8 schematically illustrates a magnetic assembly according to a second embodiment of the present invention.

FIG. 8 schematically illustrates a magnetic assembly according to a second embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5B of this embodiment comprises plural low-permeability structures 505, for example three low-permeability structures 505. The plural low-permeability structures 505 are discretely formed in the first magnetic leg 501. For example, the low-permeability structure 505 is made of air. In other words, the plural low-permeability structures 505 are distributed air gaps, wherein the number of the air gaps is larger than 1.

Figure 9:
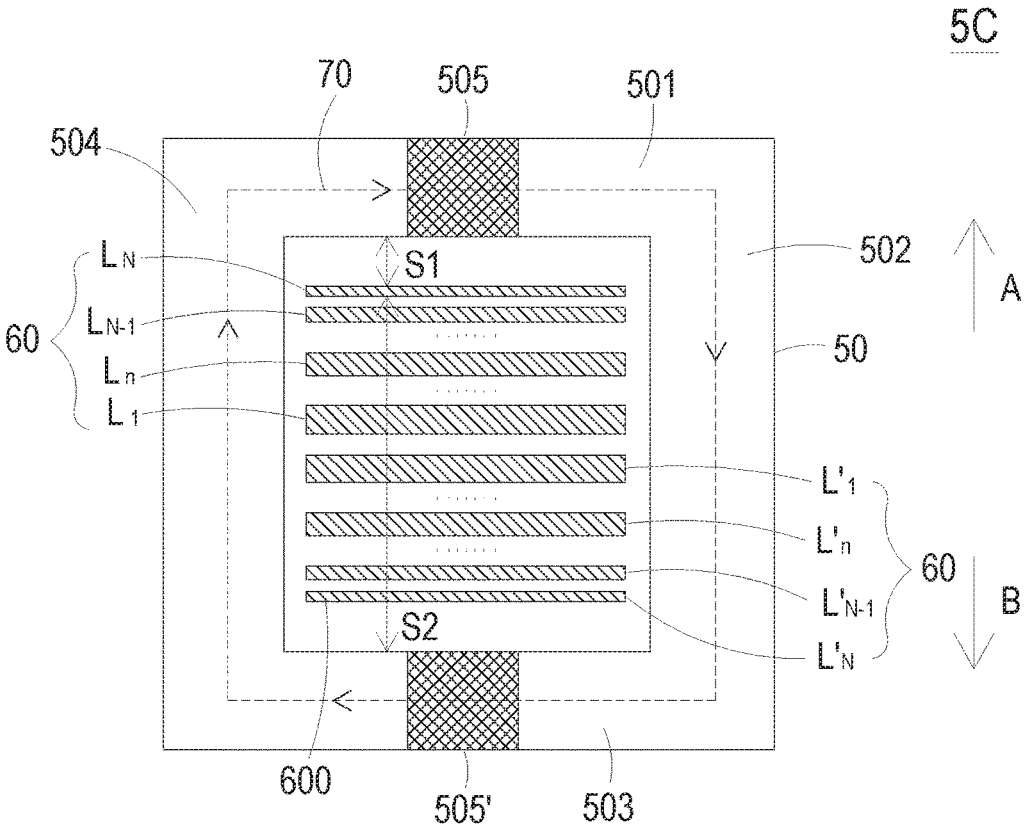
FIG. 9 schematically illustrates a magnetic assembly according to a third embodiment of the present invention.

FIG. 9 schematically illustrates a magnetic assembly according to a third embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5C of this embodiment comprises two low-permeability structures 505 and 505'. The two low-permeability structures 505 and 505' are formed in the first magnetic leg 501 and the third magnetic leg 503, respectively. Since the two low-permeability structures 505 and 505' are opposed with each other, the distance between the conductor of each winding part 600 and the low-permeability structures 505 and 505' is determined by the conductor of the winding part 600 and the closest low-permeability structure. In this embodiment, the plural winding parts 600 can be divided into a first portion (e.g., $L_1$~$L_n$ layers) and a second portion (e.g., $L'_1$~$L'_n$ layers). The winding parts 600 belonging to the first portion are closer to the low-permeability structure 505, and the winding parts 600 belonging to the second portion are closer to the low-permeability structure 505'. For example, the distance S1 between the $L_N$ layer and the low-permeability structure 505 is shorter than the distance S2 between the $L_N$ layer and the low-permeability structure 505'. Consequently, the $L_N$ layer belongs to the first portion. The winding parts 600 in the first portion are gradually close to the low-permeability structure 505 along an arranging direction A, and the conductor thicknesses of these winding parts 600 are gradually decreased along the arranging direction A. Similarly, the winding parts 600 in the second portion are gradually close to the low-permeability structure 505' along another arranging direction B, and the conductor thicknesses of these winding parts 600 are gradually decreased along the arranging direction B. Since the $L_1$ layer in the first portion is the farthest from the low-permeability structure 505 and the $L'_1$ layer in the second portion is the farthest from the low-permeability structure 505', the $L_1$ layer and the $L'_1$ layer are the thickest. Moreover, since the $L_N$ layer in the first portion is the closest to the low-permeability structure 505 and the $L'_N$ layer in the second portion is the closest the low-permeability structure 505', the $L_N$ layer and the $L'_N$ layer are the thinnest.

Figure 10:
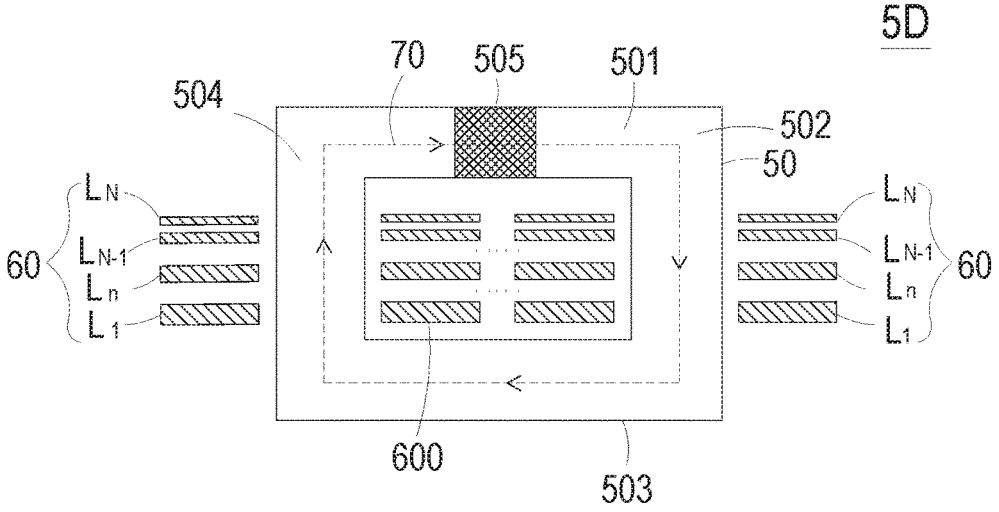
FIG. 10 schematically illustrates a magnetic assembly according to a fourth embodiment of the present invention.

FIG. 10 schematically illustrates a magnetic assembly according to a fourth embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5D of this embodiment comprises two foil winding assemblies 60. The two foil winding assemblies 60 are disposed on the second magnetic leg 502 and the fourth magnetic leg 504. The two foil winding assemblies 60 are implemented with a multi-layered printed circuit board. Moreover, the multi-layered circuit board has two perforations (not shown) for the second magnetic leg 502 and the fourth magnetic leg 504 to pass through.

Figure 11:
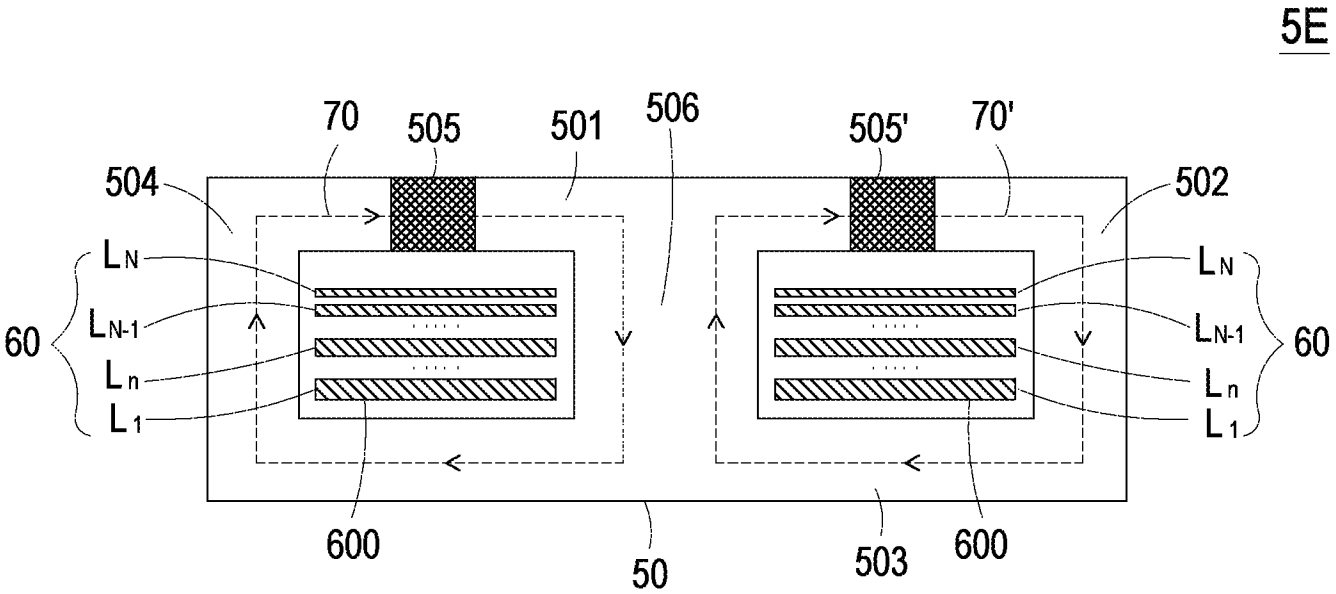
FIG. 11 schematically illustrates a magnetic assembly according to a fifth embodiment of the present invention.

FIG. 11 schematically illustrates a magnetic assembly according to a fifth embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5E of this embodiment comprises two low-permeability structures 505 and 505', and the magnetic core 50 is an EE-type core or an EI-type core. In this embodiment, the magnetic core 50 comprises a first magnetic leg 501, a second magnetic leg 502, a third magnetic leg 503, a fourth magnetic leg 504 and a central leg 506. The central leg 506 is perpendicular to the middle regions of the first magnetic leg 501 and the third magnetic leg 503, and arranged between the second magnetic leg 502 and the fourth magnetic leg 504. A first magnetic path 70' and a second magnetic path 70 are defined by the magnetic core 50. The first magnetic path 70' is defined by a part of the first magnetic leg 501, the second magnetic leg 502, the central leg 506 and a part of the third magnetic leg 503. The second magnetic path 70 is defined by the other part of the first magnetic leg 501, the fourth magnetic leg 504, the central leg 506 and the other part of the third magnetic leg 503. The low-permeability structure 505' is formed in the first magnetic leg 501 corresponding to the first magnetic path 70', and the low-permeability structure 505 is formed in the first magnetic leg 501 corresponding to the second magnetic path 70. The foil winding assembly 60 is implemented with a multi-layered printed circuit board. Moreover, the multi-layered circuit board has a perforation (not shown) for the central leg 506 to pass through.

Figure 12:
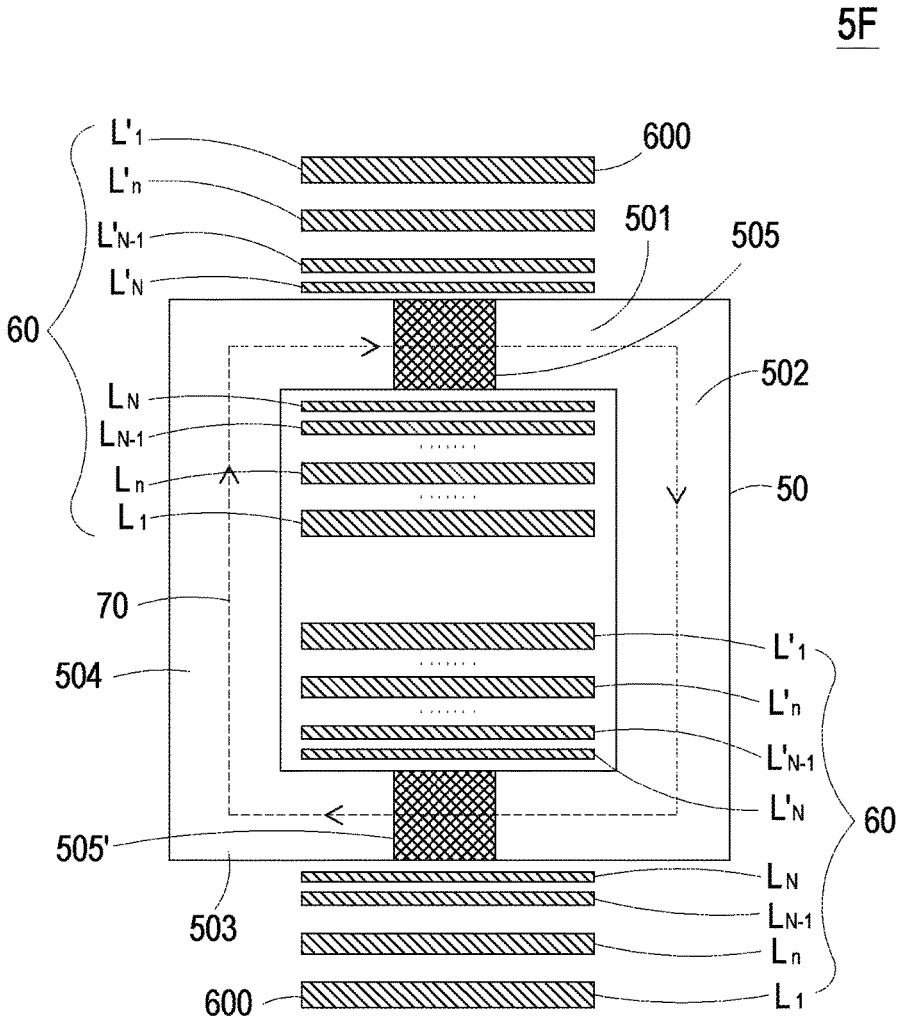
FIG. 12 schematically illustrates a magnetic assembly according to a sixth embodiment of the present invention.

FIG. 12 schematically illustrates a magnetic assembly according to a sixth embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5F of this embodiment comprises two foil winding assemblies 60 and two low-permeability structures 505 and 505'. The two low-permeability structures 505 and 505' are formed in the first magnetic leg 501 and the third magnetic leg 503, respectively. The two foil winding assemblies 60 are wound around the first magnetic leg 501 and the third magnetic leg 503, respectively. In this embodiment, the two foil winding assemblies 60 are metal foil winding assemblies such as copper foil winding assemblies or aluminum winding assemblies. Moreover, the two foil winding assemblies 60 are wound around the first magnetic leg 501 and the third magnetic leg 503 in a multi-layered winding manner.

Figure 13:
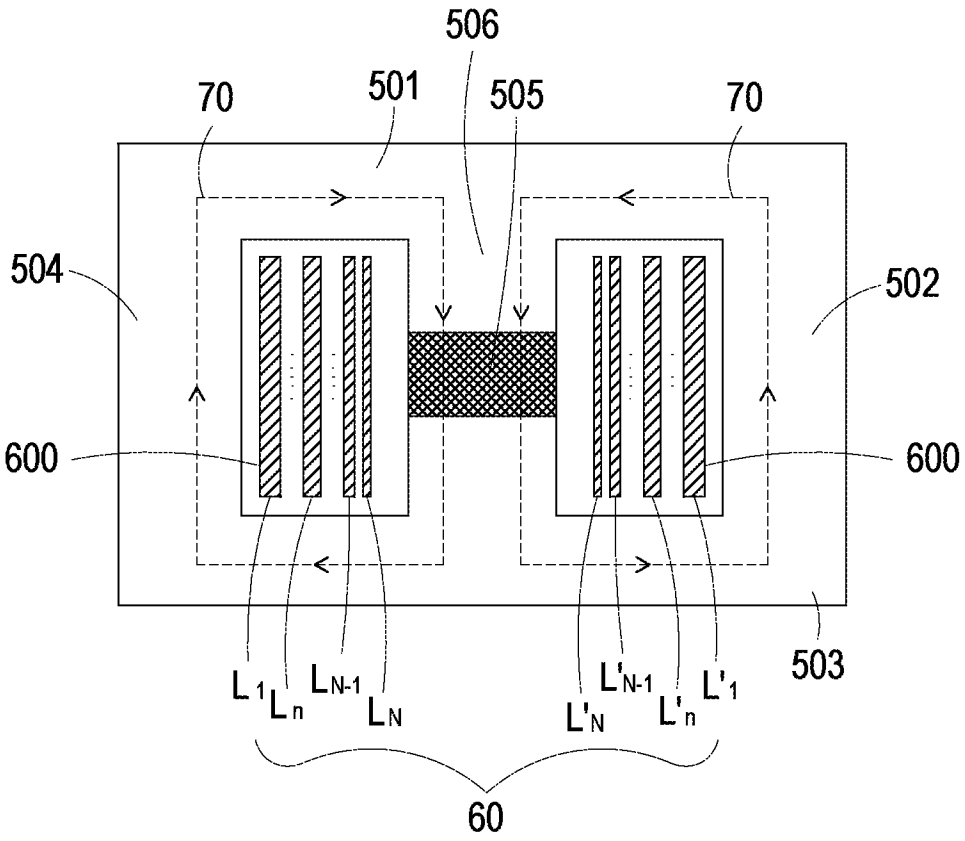
FIG. 13 schematically illustrates a magnetic assembly according to a seventh embodiment of the present invention.

FIG. 13 schematically illustrates a magnetic assembly according to a seventh embodiment of the present invention. Component parts and elements corresponding to those of the first embodiment are designated by identical numeral references, and detailed descriptions thereof are omitted. In comparison with the magnetic assembly 5A of FIG. 3, the magnetic assembly 5G of this embodiment comprises a magnetic core 50, a foil winding assembly 60 and a low-permeability structure 505. The magnetic core 50 is an EE-type core or an EI-type core. In this embodiment, the magnetic core 50 comprises a first magnetic leg 501, a second magnetic leg 502, a third magnetic leg 503, a fourth magnetic leg 504 and a central leg 506. The central leg 506 is perpendicular to the middle regions of the first magnetic leg 501 and the third magnetic leg 503, and arranged between the second magnetic leg 502 and the fourth magnetic leg 504. In this embodiment, the low-permeability structure 505 is formed in the central leg 506. The foil winding assembly 60 is a metal foil winding assemblies such as a copper foil winding assembly or an aluminum winding assembly. Moreover, the foil winding assembly 60 is wound around the central leg 506.

It is noted that numerous modifications and alterations may be made while retaining the teachings of the invention.

From the above description, the present invention provides a magnetic assembly. Since the conductor thicknesses of the winding parts of the foil winding assembly are optimized, the winding loss of the magnetic assembly is reduced. When the magnetic assembly is used in the high-frequency application, the magnetic assembly has reduced winding loss without the need of increasing the volume of the magnetic assembly. Consequently, the miniaturization of the switching power supply apparatus is achievable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic assembly, comprising:

a magnetic core comprising plural magnetic legs, wherein at least one magnetic path is defined by the plural magnetic legs collaboratively, wherein at least one low-permeability structure is formed in at least one specified magnetic leg of the plural magnetic legs; and at least one foil winding assembly wound around at least one specified magnetic leg of the plural magnetic legs so that plural winding parts in a multi-layered arrangement are sequentially stacked on the specified magnetic leg, wherein a direction of a conductor thickness of each winding part is perpendicular to a direction of a magnetic flux through the specified magnetic leg, wherein the plural winding parts are gradually close to the low-permeability structure along an arranging direction, and the conductor thicknesses of at least two of the plural winding parts are gradually decreased along the arranging direction.

2. The magnetic assembly according to claim 1, wherein a conductor of each winding part has a rectangular cross section, and a width-to-thickness ratio of the conductor is larger than 5.

3. The magnetic assembly according to claim 1, wherein the plural magnetic legs include a first magnetic leg, a second magnetic leg, a third magnetic leg and a fourth magnetic leg, wherein the first magnetic leg and the third magnetic leg are in parallel with each other, the second magnetic leg and the fourth magnetic leg are in parallel with each other, and the first magnetic leg and the third magnetic leg are respectively perpendicular to the second magnetic leg and the fourth magnetic leg.

4. The magnetic assembly according to claim 3, wherein one low-permeability structure is formed in the first magnetic leg.

5. The magnetic assembly according to claim 4, wherein an additional low-permeability structure is formed in the third magnetic leg.

6. The magnetic assembly according to claim 3, wherein the plural magnetic legs further comprise a central leg, and the central leg is connected with the first magnetic leg and the third magnetic leg and arranged between the second magnetic leg and the fourth magnetic, wherein a first magnetic path is defined by a part of the first magnetic leg, the second magnetic leg, the central leg and a part of the third magnetic part, and a second magnetic path is defined by the other part of the first magnetic leg, the fourth magnetic leg, the central leg and the other part of the third magnetic leg.

7. The magnetic assembly according to claim 6, wherein a first low-permeability structure is formed in the specified part of the first magnetic leg corresponding to the first magnetic path, and a second low-permeability structure is formed in the specified other part of the first magnetic leg corresponding to the second magnetic path.

8. The magnetic assembly according to claim 6, wherein the low-permeability structure is formed in the central leg, and the foil winding assembly is wound around the central leg.

9. The magnetic assembly according to claim 1, wherein the distance between each winding part and the low-permeability structure is determined by the distance between the winding part and the closest low-permeability structure.

10. The magnetic assembly according to claim 9, wherein the conductor thicknesses of the plural winding parts are gradually decreased along the arranging direction in steps, wherein the number of the steps is arbitrary.

11. The magnetic assembly according to claim 10, wherein each step corresponds to one winding part or a specified number of adjacent winding parts.

12. The magnetic assembly according to claim 1, wherein the plural winding parts have different conductor thicknesses.

13. The magnetic assembly according to claim 1, wherein the at least one low-permeability structure comprises plural low-permeability structures, wherein the low-permeability structures are distributed air gaps, and the number of the air gaps is larger than 1.

14. The magnetic assembly according to claim 1, wherein the low-permeability structure is made of a low permeability material with permeability in a range between 1 and 50.

15. The magnetic assembly according to claim 1, wherein the foil winding assembly is a copper foil winding assembly, an aluminum foil winding assembly or a multi-layered printed circuit board.

* * * * *